United States Patent [19]

Capp et al.

[11] Patent Number: 4,799,900

[45] Date of Patent: Jan. 24, 1989

[54] PUSH ON RIGHT ANGLE CONNECTOR

[75] Inventors: Randolph E. Capp, Mechanicsburg; Michael M. Johnescu, York; Ronald C. Laudig, Mechanicsburg; George W. Michael, Harrisburg; Donald L. Smith, Middletown, all of Pa.

[73] Assignee: AMP Incorporated, Harrisburg, Pa.

[21] Appl. No.: 176,969

[22] Filed: Apr. 4, 1988

Related U.S. Application Data

[63] Continuation-in-part of Ser. No. 109,350, Oct. 15, 1987, Pat. No. 4,772,222.

[51] Int. Cl.[4] ..... H01R 17/18

[52] U.S. Cl. ..... 439/585; 439/468; 439/855; 439/881; 439/904

[58] Field of Search ..... 439/578–585, 439/675, 468, 466, 855, 881, 901–906, 874, 607–610

[56] References Cited

U.S. PATENT DOCUMENTS

| | | | |
|---|---|---|---|
| 2,335,041 | 11/1943 | Bruno | 174/87 |
| 3,047,828 | 7/1962 | Gregson et al. | 339/64 |
| 3,836,946 | 9/1974 | Geiger | 339/177 R |
| 4,047,788 | 9/1977 | Forney, Jr. et al. | 339/177 R |
| 4,049,902 | 9/1977 | de Ronde | 174/35 C |
| 4,096,627 | 6/1978 | Forney, Jr. et al. | 29/628 |
| 4,156,554 | 5/1979 | Aujla | 339/177 R |
| 4,261,630 | 4/1981 | Knappenberger | 339/31 R |
| 4,557,546 | 12/1985 | Dreyer | 339/177 R |
| 4,655,534 | 4/1987 | Stursa | 339/177 R |

OTHER PUBLICATIONS

IS 1914-5-Rev. 6/28/73-Amp Inc. Data Sheet 80-600 Issued 3-81-Amp Inc. "Microminiature Coaxicon Contact".

*Primary Examiner*—David Pirlot
*Attorney, Agent, or Firm*—Gerald K. Kita

[57] ABSTRACT

A kit of parts, comprising; a connector shell (7) for a coaxial cable (2) having a tool receiving cavity portion (11) open toward two orthogonal directions, a contact holder (14) and a cable holder (15), an insulative body (70) and a conductive cover (51) for covering the cavity portion (11) of the shell (7), and a conductive ferrule (38) for wedge fit assembly with the cable holder (15), the cover (51) having hooks (52,52) for engaging the shell (7), and the shell (7) having cover supports (12,12) for engaging and deflecting the cover (51) to a bent position.

4 Claims, 3 Drawing Sheets

PUSH ON RIGHT ANGLE CONNECTOR

CROSS REFERENCE TO RELATED APPLICATION

This application is a, continuation in part of application Ser. No. 109,350 now Patent No. 4,772,222 filed Oct. 15, 1987, the disclosure of which is expressly incorporated by reference herein.

FIELD OF THE INVENTION

This specification relates to an electrical connector that accommodates a soldering tool for assembly of the connector to an electrical coaxial cable.

BACKGROUND OF THE INVENTION

There is disclosed in U.S. Pat. No. 4,049,902 a connector comprising a conductive shell having a tool receiving cavity, a cable holder extending from the cavity for receiving an electrical cable for connection to an electrical conductor within the interior of the shell and a cover for covering the cavity.

In this known connector, the tool receiving cavity allows access of a soldering tool to the interior of the shell to manufacture a solder joint between the electrical cable and the electrical conductor within the shell. Access for the tool is limited by the size of the cavity which is no larger than the diameter of the shell that surrounds the cavity and the cover.

SUMMARY OF THE INVENTION

The connector of the invention includes a conductive shell constructed with a tool receiving cavity that is not limited in size by the diameter of the shell.

According to the invention, the connector includes a conductive shell constructed with opposite sides and additional converging sides that bridge between the opposite sides to define a tool receiving cavity open toward two orthogonal directions, and a cover for covering the tool receiving cavity and extending along the two orthogonal directions.

According to common practice, a circular covêr for the tool receiving cavity is attached to the shell by a friction fit or by screw threads.

Further according to the invention, cover engaging supports along opposite sides of the shell engage and resiliently deflect a cover along its length to retain the cover in a bent position in engagement against the supports and extended in two orthogonal directions over a tool receiving cavity open toward the two orthogonal directions.

Further according to the invention a connector comprises, a conductive shell having a tool receiving cavity, a cable holder extending from the cavity for receiving an electrical cable for connection to the shell and for connection within the shell to an electrical conductor within the shell, a cover for covering the cavity, and further, a conductive auxiliary shell is mounted within the conductive shell and provides radially spaced apart spring fingers encircling concentrically the conductor mounted in the shell for gripping onto a complementary connector.

Other advantages of the invention are apparent from embodiments of the invention described by way of example with reference to the accompanying drawings.

DETAILED DESCRIPTION

Figure 1:
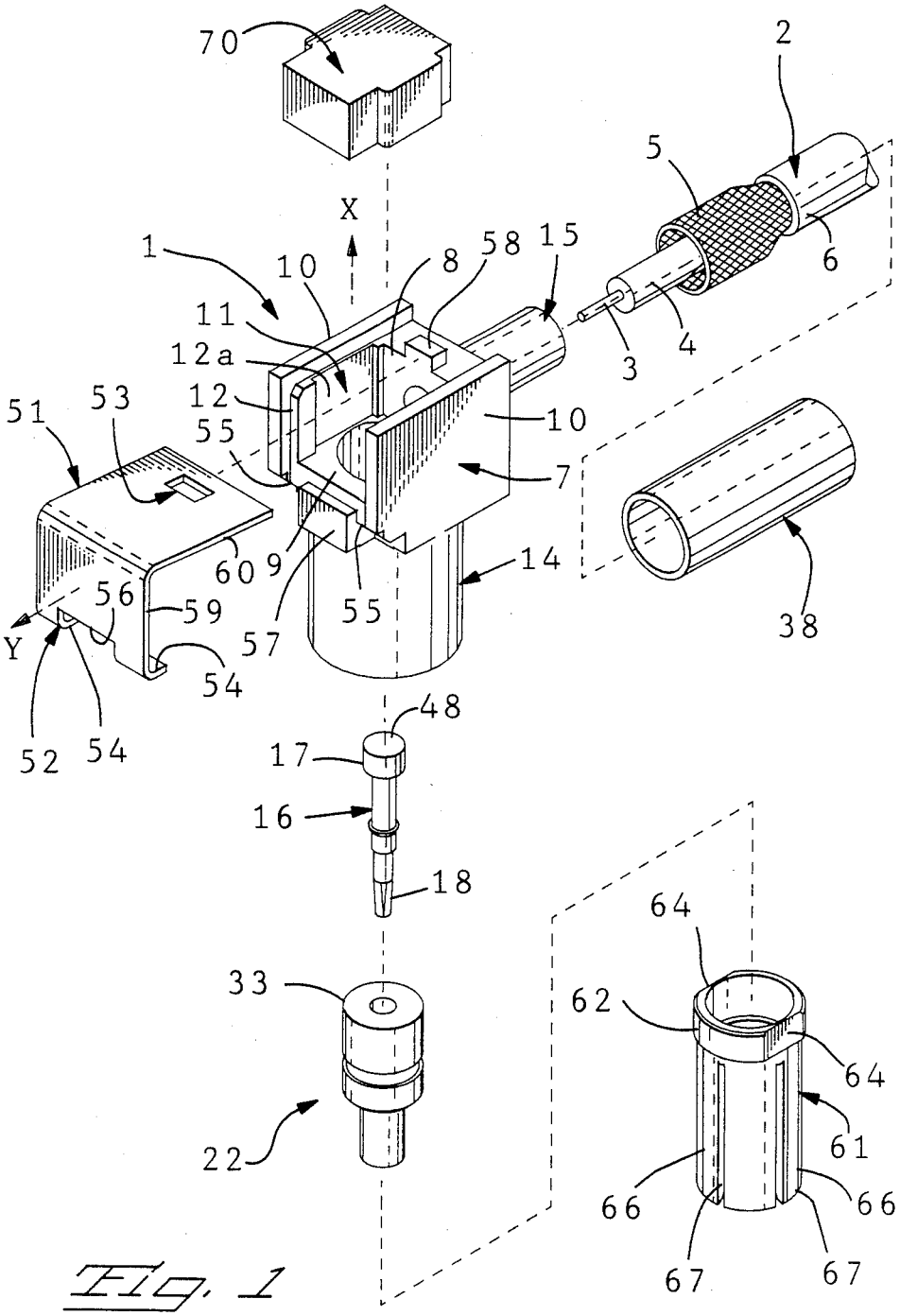
FIG. 1 is an enlarged fragmentary perspective view of an embodiment, by way of example, including a connector and a coaxial cable with parts in exploded configuration.
Figure 2:
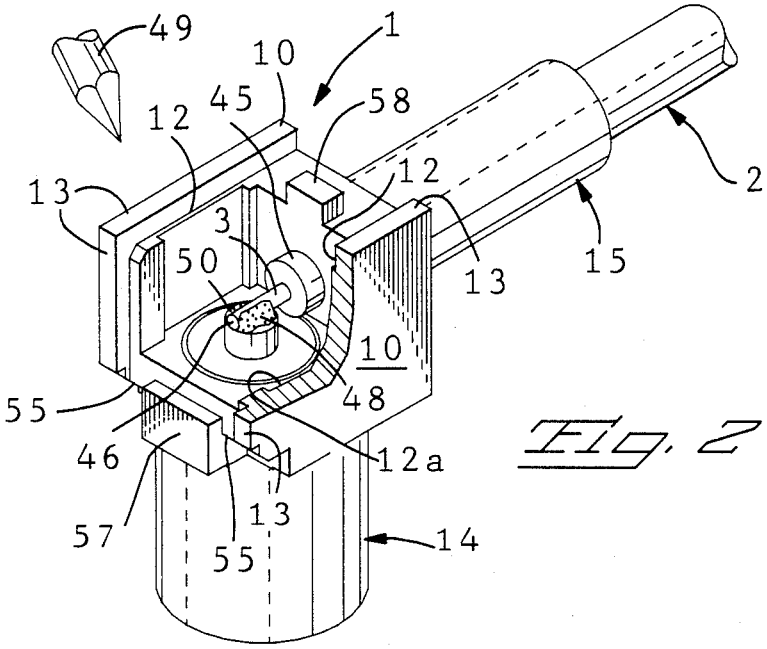
FIG. 2 is an enlarged perspective view of the connector shown in FIG. 1 with parts of the connector assembled and a solder connection between an electrical contact of the connector and a center conductor of the cable shown in FIG. 1.
Figure 3:
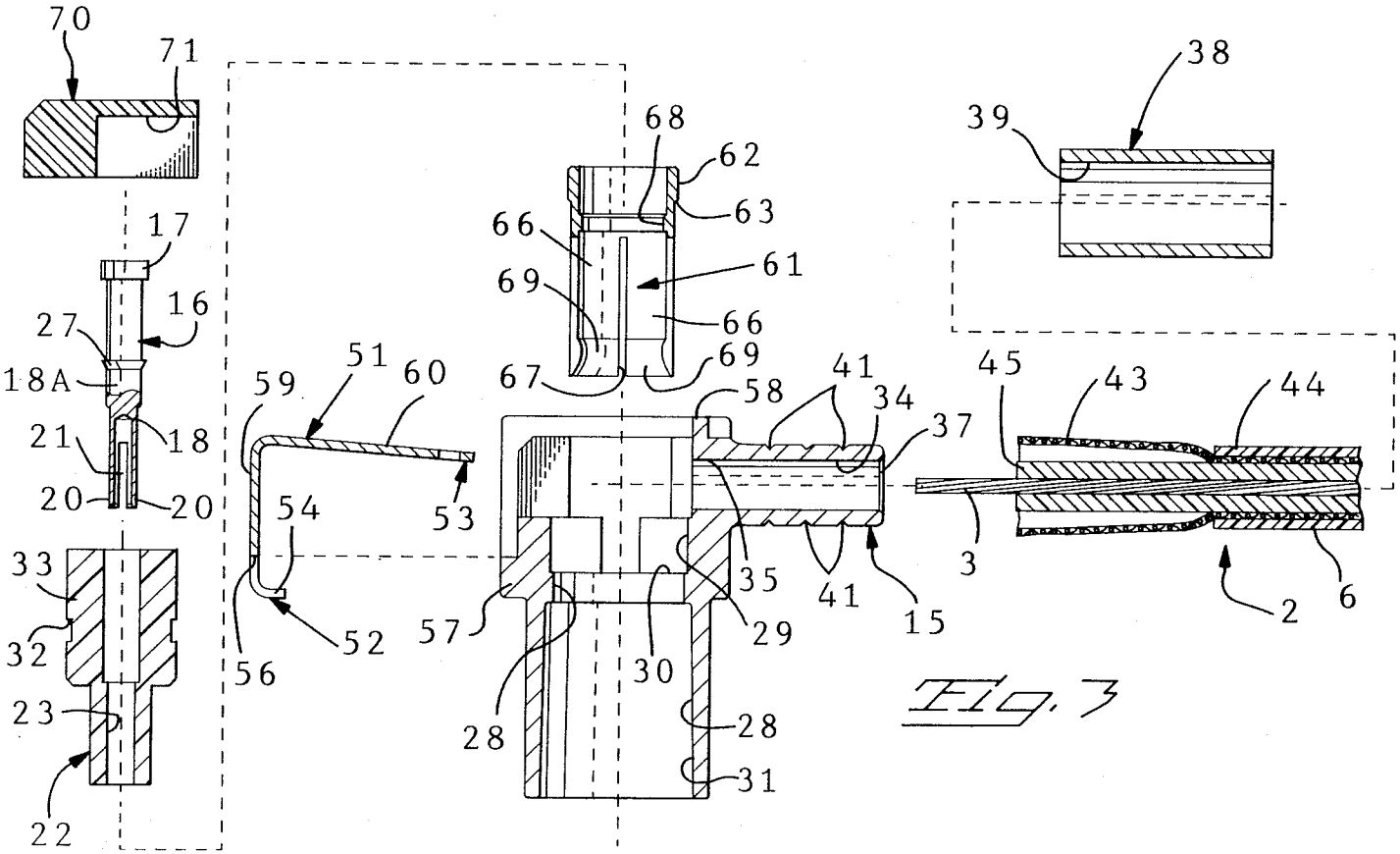
FIG. 3 is a side elevation view of the connector and the cable shown in FIG. 2, with parts exploded and with parts in section.

With more particular reference to FIGS. 1 and 3 there is shown an electrical connector 1 for a coaxial cable 2. The cable 2 includes a center conductor 3 concentrically encircled by an insulative layer 4 called a cable dielectric, in turn, concentrically encircled by a conductive sheath 5 constructed, for example, by multiple stands of wires woven or braided together, in turn, concentrically encircled by an insulative jacket 6.

A conductive shell 7 of the connector has intersecting sides 8,9 that bridge between opposite sides 10,10 and define a tool receiving cavity portion 11 open toward two orthogonal directions, as shown at x and at y. The shell 7 includes cover engaging supports 12,12 in the form of ledges along the opposite sides 10,10 and recessed from the edges 13,13 of the opposite sides 10,10. The shell 7 includes a contact holder 14 and a cable holder 15 extending from the cavity portion 11. For example, the shell 7 can be fabricated by machining.

A conductive electrical contact 16 of the connector 1 is spaced from and concentrically encircled by the contact holder 14. The contact 16 includes an enlarged end portion 17 and an axially extending, reduced diameter, electrical receptacle portion 18. The receptacle portion 18 includes an open end 19 encircled by spring fingers 20,20 spaced apart from one another by axially extending slots 21. The spring fingers are for gripping onto a complementary connector, not shown. The contact 16 includes further a stepped intermediate larger diameter portion 18*a*.

An insulative body 22 of the connector is assembled with the contact 16. The insulative body 22 has an axial bore 23 receiving the receptacle portion 18 of the contact 16. The end portion 17 of the contact 16 is seated against an end of the body 22. The contact 16 has a shoulder 25 at an intersection of the end portion 17 and the receptacle portion 18. The shoulder 25 is engaged and seated against the end of the body 22. The receptacle portion 18 includes an external encircling barb 27 inclined axially toward the end portion 17 and imbedded in the insulative body 22. An auxiliary conductive shell 61 of the contact holder 14 is cylindrical and hollow, and is provided with an external enlarged diameter portion 62 at one end and defining a radially projecting shoulder 63. The enlarged diameter portion 62 is reduced by external flat surfaces 64, 64 that are radially opposite each other. The opposite end portion 65 is an electrical receptacle having radially spaced spring fingers 66, 66 defined between axially extending slits 67. The shell 61 includes an internal radially projecting collar 68 and internal projections 69, 69 on corresponding fingers 66, 66.

The insulative body 22 and the contact 16 are assembled with the auxiliary shell 61 and contact holder 14.

Figure 4:
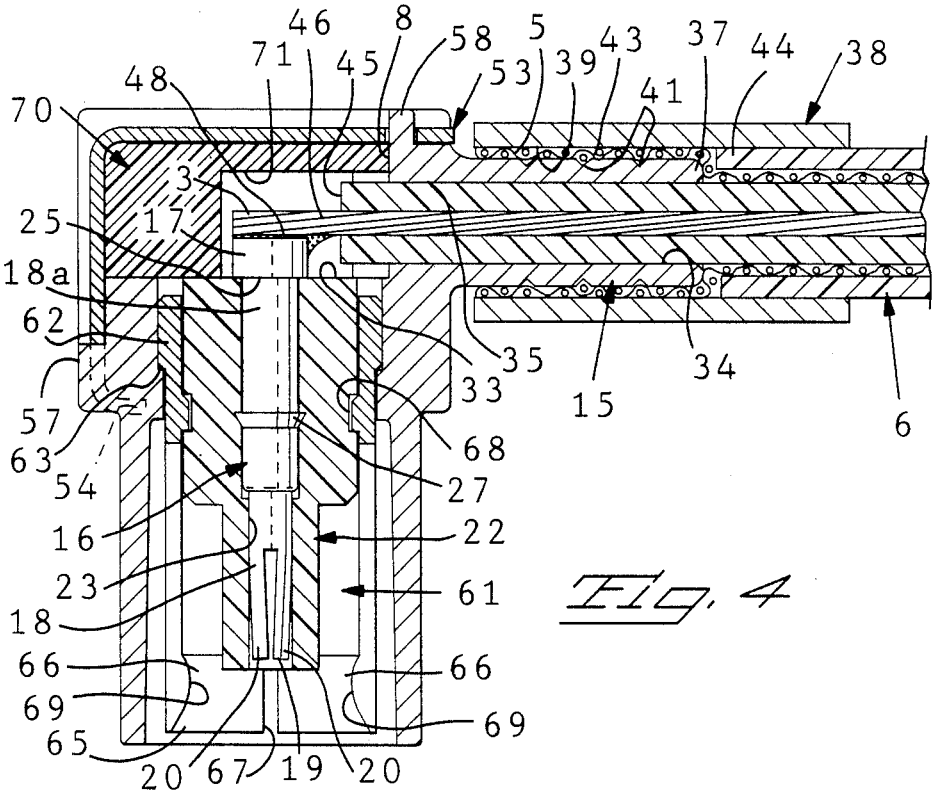
FIG. 4 is a side elevation view of an assembly of the parts shown in FIG. 3.

The contact holder 14 includes an axially extending stepped bore 28 having a smaller bore portion 29 communicating with the interior of the cavity portion 11. An internal encircling wall 30 of the contact holder 14 is at an intersection of a larger bore portion 31 and a smaller bore portion 29. The shoulder 63 of the auxiliary shell 61 engages and seats against the wall 30. The portion 62 of the auxiliary shell 61 is press fit and engaged against the inner diameter of the contact holder 14. The flat surfaces 64,64 provide clearances to allow passage of the enlarged diameter portion 62 past the ledges 12,12. The ledges 12,12 are provided with lateral recesses **12*a*,12*a* to allow passage of the auxiliary shell 61 through the cavity 11 and with the contact holder 14. A clearance is concentrically between the electrical receptacle end portion 65 and the interior of the contact holder 14. The insulative body 22 has an external encircling shoulder 32 engaged and seated against the collar 68. As shown in FIG. 4, the enlarged end portion 17 of the contact 16 projects into the interior of the cavity portion 11. An end 33 of the insulative body 22 projects into the interior of the cavity portion 11 and prevents electrical contact of the cavity portion 11 with the contact 16. The insulative body 22 concentrically encircles the contact 16, while the end portion 17 projects from the insulative body 22. The end portion 17 of the contact 16 is positioned in the cavity portion 11 to receive and engage the center conductor 3 of coaxial cable 2 extended along the cable holder 15 and projecting into the cavity portion 11. The cable holder 15 of the connector 1 includes an axial passage 34 communicating with the interior of the cavity portion 11, and communicating with an end 37 of the cable holder 15**.

A conductive cylindrical ferrule 38 has an axial passage 39. As shown in FIGS. 3 and 4, a protruding portion 43 of the conductive sheath 5 protrudes from a cut end 44 of the insulative jacket 6. A protruding portion 45 of the insulative layer 4 protrudes from the cut end 44 of the cable jacket 6. A protruding portion 46 of the center conductor 3 protrudes from a cut end of the insulative layer portion 45. The ferrule 38 and cable 2 are assembled with the connector 1. The cable 2 is inserted into the passage 34 of the cable holder 15. The sheath 5 is compressed between the ferrule 38 and the cable holder 15 to establish an electrical connection with the cable holder 15. The sheath 5 is forced into a series of grooves 41,41 on the cable holder 15 to establish a firm grip of the sheath 5 by the cable holder 15 and the ferrule 38. The protruding portions 45,46 of the insulative layer 4 and the center conductor 3 project through the reduced diameter portion 35 of the passage 34 and into the interior of the cavity portion 11. The wall 8 prevents the conductive sheath 5 from entering the interior of the cavity portion 11. The protruding portion 45 of the insulative layer 6 projects past the wall 8 and prevents electrical engagement of the wall 8 with the center conductor 3. The center conductor 3 overlaps the end portion 17 of the contact 16. The end portion 17 of the contact 16 is positioned in the cavity portion 11 and alongside the axis of the cable holder 15 and has a conductive solder receiving region 48. The open construction of the tool receiving cavity 11 provides access by a tool 49, for example, a tip of a soldering tool. The tool 49 applies heat and pressure to the portion 46 of the center conductor 3 and the end portion 17 of the contact 16 to melt a quantity of solder 50 that adheres on the solder region 48 of the end portion 17 of the contact 16. The solder 50 is applied on the solder region 48 either during the soldering operation or before assembly of the ferrule 38 and the cable 2 with the cable holder 15.

An insulative body 70 is shaped to conform to the interior of the cavity portion 11 extending between the ledges 12,12. An inverted recess 71 of the insulative body 70 provides a clearance for receiving the portion 46 of the center conductor 3 and the end portion 17 of the contact 16 electrically connected together by a solder joint formed by the solder 50.

The connector 1 further includes an elongated conductive cover 51 fabricated from a strip of metal. Hooks 52,53 are provided at opposite ends of the cover 51. At one end the hook 52 is a pair of tabs 54,54 that overlap a corner edge 55 of the cavity portion 11. The tabs 54,54 are spaced apart and define a keyway 56. A projecting key 57 of the cavity portion 11 aligns with the keyway 56 and aligns the cover 51 during assembly. At the other end of the cover 51 the hook 53 is a hasp for registration with a projection 58 of the cavity portion 11. Assembly of the cover 51 is accomplished by hooking the tabs 54,54 on the corner edge 55 and moving the cover 51 to hook the hasp 53 on the projection 58. As shown in FIG. 3, the surfaces of supports 12,12 extend to a corner having a first angle. The cover 51 has first and second portions 59,60 that intersect each other at a second angle more acute than the first angle. With the cover 51 covering the cavity portion 11 of the shell 7, the supports 12,12 engage and resiliently deflect the cover 51 to a position bent along its length to conform to the surfaces of the supports 12,12. The hooks 52,53 engage the shell 7 and retain the cover 51 in a bent position and in engagement against the supports 12,12. The cover 51 retains stored spring energy to maintain pressure of the hooks 52,53 against the shell 7.

The connector 1 may be supplied as a kit of parts, with the ferrule 38, the insulator 70 and the cover 51 separate from the shell 7, and with the contact 16 and insulative body 22 installed in the shell 7. The connector 1 as a kit of parts is readily assembled with a coaxial cable 2. The cavity portion 11 can be of relatively small size, and yet the open construction of the cavity portion 11 allows access to the interior of the connector 1. The cable holder 15 and the contact holder 14 project outwardly from the cavity portion 11, and can have diameters less than the width or height of the cavity portion 11.

We claim:

1. In a connector comprising, a conductive shell having a tool receiving cavity, an electrical conductor within the shell, a cable holder extending from the cavity for receiving an electrical cable for connection to the shell and for connection within the interior of the shell to the electrical conductor and a cover for covering the cavity; the improvement comprising;

the conductive shell is constructed with opposite sides and additional converging sides that bridge between the opposite sides to define a tool receiving cavity open continuously toward two orthogonal directions, the cover has a length for covering the tool receiving cavity and extending along the two orthogonal directions, and a conductive auxiliary shell engages and is encircled by the first recited shell.

2. In a connector as recited in claim 1, the improvement further comprising; an insulative body fitting in the cavity and under the cover, the insulative body having a recess for receiving a portion of the conductor.

3. In a connector as recited in claim 1, the improvement further comprising, a holder of the shell receiving the auxiliary shell, cover engaging supports along corresponding said sides of the shell, and recesses in the supports to allow passage of the auxiliary shell into the holder.

4. In a connector as recited in claim 3, the improvement further comprising; surfaces on the auxiliary shell providing clearances to allow passage of the shell past the cover engaging supports and into the holder.

* * * * *